US007291229B2

(12) United States Patent
Ishii et al.

(10) Patent No.: US 7,291,229 B2
(45) Date of Patent: Nov. 6, 2007

(54) METHOD OF SURFACE TREATMENT OF TITANIUM METAL

(75) Inventors: Eiichi Ishii, Hyogo (JP); Takumi Sone, Osaka (JP); Yukihiro Sato, Hyogo (JP); Kei Demizu, Osaka (JP); Hideo Kakutani, Osaka (JP); Koichi Tanaka, Osaka (JP); Shinichi Tanaka, Osaka (JP); Noriyoshi Tsuji, Osaka (JP)

(73) Assignees: Osaka Prefecture, Osaka (JP); Tanaka Limited, Osaka (JP); SDC Incorporated, Osaka (JP)

( * ) Notice: Subject to any disclaimer, the term of this patent is extended or adjusted under 35 U.S.C. 154(b) by 285 days.

(21) Appl. No.: 10/659,327

(22) Filed: Sep. 11, 2003

(65) Prior Publication Data

US 2004/0084113 A1 May 6, 2004

Related U.S. Application Data

(63) Continuation-in-part of application No. 09/902,260, filed on Jul. 11, 2001, now abandoned.

(30) Foreign Application Priority Data

Jul. 12, 2000 (JP) ..... 2000-211518

(51) Int. Cl.
*C23C 8/20* (2006.01)
*C23C 8/36* (2006.01)
*C22C 14/00* (2006.01)

(52) U.S. Cl. ..... 148/222; 148/237; 148/316

(58) Field of Classification Search ..... None
See application file for complete search history.

(56) References Cited

U.S. PATENT DOCUMENTS 4,587,458 A * 5/1986 Davenport et al. ..... 315/111.01
5,062,900 A 11/1991 Berneron et al.
5,198,285 A * 3/1993 Arai et al. ..... 428/216
5,466,305 A 11/1995 Sato et al.
5,593,511 A 1/1997 Foster et al.
5,908,671 A 6/1999 Tanaka et al.
6,238,490 B1 * 5/2001 Bell et al. ..... 148/222

FOREIGN PATENT DOCUMENTS

GB 2 261 227 5/1993
JP 07-090542 4/1995
RO 108000 B1 * 1/1994
WO 98/43284 10/1998
WO WO 99/04056 A1 * 1/1999

* cited by examiner

*Primary Examiner*—Harry D Wilkins, III
(74) *Attorney, Agent, or Firm*—Wenderoth, Lind & Ponack, L.L.P.

(57) ABSTRACT

A method of carburizing treatment is proposed in which if carburizing is carried out at a low temperature, carbon will not turn amorphose and deposit on the surface of a titanium metal but reliably penetrate into between metallic atoms. It is a method of surface treatment of a titanium metal comprising the steps of heating the titanium metal to a temperature of 400-690° C. in a cleaning gas atmosphere containing hydrogen gas, subjecting the surface of the titanium metal to cleaning by applying a DC voltage of 200-1500 V, and plasma carburizing in an atmosphere comprising a carburizing gas having an atomic weight ratio of hydrogen atoms (H) to carbon atoms (C) adjusted to $1 \leqq H/C \leqq 9$ at a pressure of 13-400 Pa and a temperature of 400-690° C. Ionization reaction in the gas is suppressed suitably. Because there exists no excessive carbon which is not used for carburization but turns soot or glass-like carbon, in the atmosphere during carburization, carburizing reaction progresses smoothly.

2 Claims, 9 Drawing Sheets

METHOD OF SURFACE TREATMENT OF TITANIUM METAL

This application is a Continuation-in-Part application of application Ser. No. 09/902,260, filed Jul. 11, 2001 now abandoned.

BACKGROUND OF THE INVENTION

This invention relates to a method of surface treatment of titanium metal.

Generally, titanium metal is heat-resistant and is substantially equal in strength to carbon steel. Also, it is known to have a good corrosion resistance because it forms an oxide film on its surface.

Also, as for pure titanium, it is possible to improve its workability and mechanical strength by forming an alloy with any metal, especially copper, tin, iron, aluminum, vanadium, chrome, cobalt, molybdenum, tungsten, etc.

As products made of a titanium metal such as pure titanium or titanium alloy, corrosion-resistant screws and bolts, spectacle frames, and medical and dental materials are known. In order to lower the friction coefficient and improve the wear resistance of such titanium metal products, plasma carburizing treatment is disclosed in Japanese patent publication 7-90542 filed by the inventors of the present application.

As disclosed in the publication, before carburizing treatment, it is necessary to remove an oxide film on the surface of the titanium metal. For this purpose, cleaning treatment is carried out in which deposits on the surface of the titanium metal are spattered by turning a mixture of hydrogen gas and argon gas into plasma.

Such cleaning treatment for a titanium metal is carried out at a high temperature of 700° C. or over in the same manner as in carburizing treatment. This is because at a temperature below 700° C., the surface would not be activated or infiltration of activated carbon would not be achieved sufficiently.

But in the carburizing and cleaning treatment by the conventional method at a high temperature of 700° C. or over, lowering of the strength due to softening of the metal matrix is unavoidable.

In particular, solution treatment is often carried out with a titanium alloy as a matrix and thereafter aging treatment at about 500-700° C. is carried out for precipitation hardening. But when it is subjected to heating treatment thereafter at 700° C. or over, a surface layer is formed which comprises a phase in which α-type (hexagonal system) and β-type (body-centered cubic system) structures are present in a mixed state. This causes not only the α type but β type structure to deposit on the surface of the titanium alloy, so that the effect of precipitation hardening of the α type by aging treatment lowers.

Also, if plasma carburizing is carried out on a titanium metal at a lower temperature than 700° C., carbon ions tend to become amorphous, so that they will not be carburized into the titanium metal but deposit on the surface in the form of soot or glass-like carbon.

An object of this invention is to carburize titanium metal so that the strength inherent to a titanium metal is maintained and excellent wear resistance and low friction coefficient and improved corrosion resistance are achieved.

Also, another object is to provide a carburizing treatment method in which when carburizing is carried out at a low temperature, carbon reliably infiltrates into between metallic atoms without turning to amorphous and depositing on the metal surface even at a lower temperature than 700° C.

SUMMARY OF THE INVENTION

According to this invention, there is provided a method of surface treatment of titanium metal wherein plasma carburizing is carried out in an atmosphere comprising a carburizing gas having an atomic weight ratio of hydrogen atoms (H) to carbon atoms (C) adjusted to $1 \leqq H/C \leqq 9$ at a pressure of 13-400 Pa and a temperature of 400-690° C.

If plasma carburizing is carried out using a carburizing gas comprising a predetermined composition by the above-said carburizing treatment method, high-voltage conditions can be used with a small current density. Thus titanium metal can be carburized from the surface to a depth exceeding 50 μm under a low pressure of 13 to 400 Pa and at a low temperature of 400 to 690° C. In plasma carburization, activated carbon ions infiltrate into the crystal lattice of the metal, metal atoms flying out of the metal surface bind to the activated carbon ions and are covering the metal surface and diffuse into the interior of the metal, or carbon ions accelerated near the cathode are directly driven into the metal, so that a carburized layer comprising a carbonized metal layer is formed on the surface layer of the titanium metal.

If a carburizing gas adjusted so as to be $1 \leqq H/C \leqq 9$ is used and the carburizing temperature and the carburizing gas pressure are within predetermined ranges, it is considered that ionization reaction in the gas is suppressed suitably, so that since there exists in the carburizing atmosphere no excessive carbon which is not used for carburization but becomes soot or glass-like carbon, carburizing reaction progresses smoothly.

Also, since plasma carburizing is carried out at a low temperature of 690° C. or lower, it is considered that as in aging treatment, an α-layer deposits on the surface of the titanium metal in which α-type (hexagonal system) and β-type (regular system) structures coexist, so that it is possible to turn many carbon atoms to solid solution on the surface to the limit of the α-type titanium metal at the predetermined temperature of plasma carburizing.

Also, in order to reliably solve the same object, a method of surface treatment of a titanium metal is preferable which comprises the steps of heating the titanium metal to a temperature of 400-690° C. in a cleaning gas atmosphere containing hydrogen gas, subjecting the surface of the titanium metal to cleaning by applying a DC voltage of 200-1500 V, and plasma carburizing in an atmosphere comprising a carburizing gas having the atomic weight ratio of hydrogen atoms (H) to carbon atoms (C) adjusted to $1 \leqq H/C \leqq 9$ at a pressure of 13-400 Pa and a temperature of 400-690° C.

When a DC current is applied while heating a titanium metal to a predetermined temperature in a cleaning gas atmosphere containing hydrogen gas, the introduced hydrogen gas is turned into plasma, and it collides against the surface of the titanium metal while accelerating due to cathode drop, thus blowing away oxides and other deposits while reducing them to efficiently clean the titanium metal surface.

Next, when the metallic surface is subjected to plasma carburization in the same manner under predetermined pressure and temperature conditions, a carburized layer comprising a carbonized metal layer will not deposit on the surface subjected to cleaning even at a low temperature, but carbon reliably penetrates into the crystal lattice to form a carburized layer.

Other features and objects of the present invention will become apparent from the following description made with reference to the accompanying drawings, in which:

DETAILED DESCRIPTION OF THE PREFERRED EMBODIMENT

Figure 1:
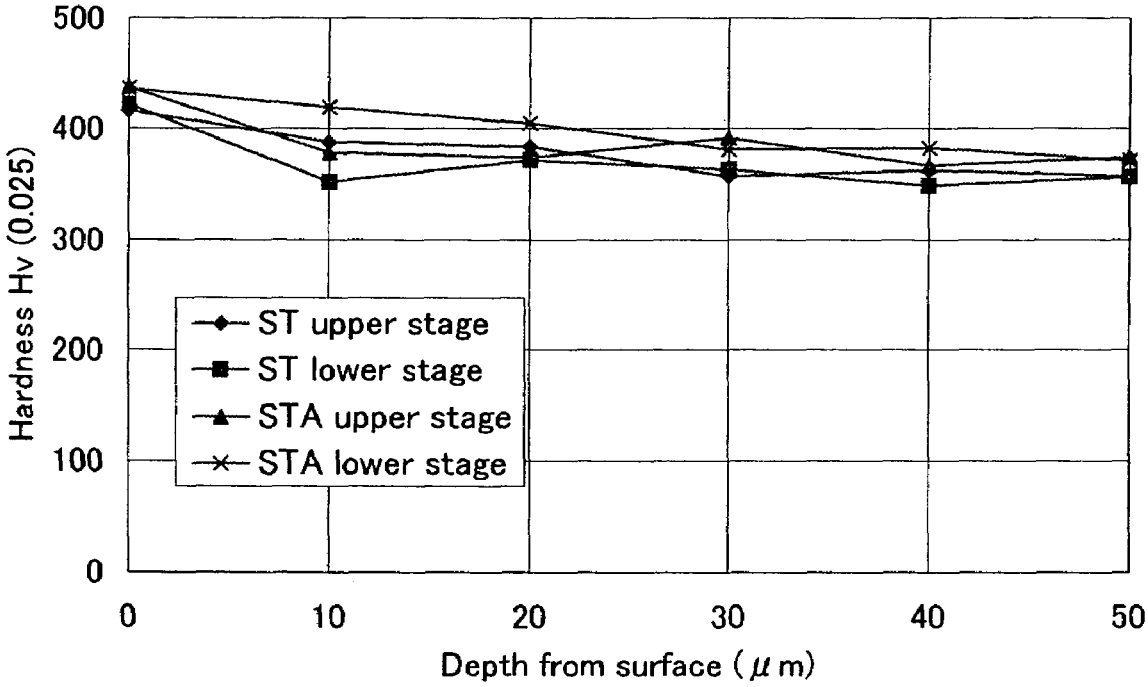
FIG. 1 is a graph showing the relation between the Hv hardness and the depth from the surface in Example 1.

The titanium metal referred to in this invention may be pure titanium or alloy of titanium and other metal component, and the composition of alloy is not particularly limited. The purity of titanium of titanium metal as an industrial material is about 99.9 to 99.5% and such pure titanium may be used.

As metal components for titanium alloy, for example, copper, tin, iron, aluminum, vanadium, chrome, cobalt, molybdenum, tungsten, etc. may be used.

A hydrocarbon-family gas used for carburizing treatment is a general term for gases consisting of only carbon and hydrogen and hydrocarbon may be either chain hydrocarbon or cyclic hydrocarbon. As examples of chain hydrocarbons, paraffinic hydrocarbons shown by formula $C_nH_{2n+2}$, olefinic hydrocarbons ($C_nH_{2n}$), acetylenic hydrocarbons ($C_nH_{2n-2}$) can be cited, and they may be straight-chain or have side chains. In particular, methane, ethane, propane and butane are preferable, which are gases at normal temperature and need no vaporizing facility for use. As for cyclic hydrocarbons, they may be aromatic compounds or cycloaliphatic compounds. A representative example of aromatic compounds is benzene ($C_6H_6$).

The atomic weight ratio of hydrogen atoms (H) to carbon atoms (C) in the carburizing gas among the above plasma carburizing conditions should be $1 \leqq H/C \leqq 9$. If the (H/C) ratio is less than 1, carburization will not proceed smoothly, so that high-hardness state will not be attained by carburizing from the titanium metal surface to the depth of 50 μm, but the carbon becomes amorphous and deposits on the titanium metal surface. Also if H/C exceeds 9, the amount of carbon ions is insufficient, so that it takes a long time for carburization, which is not economical.

The pressure of the carburizing gas should be 13 to 400 Pa. Such a carburizing gas pressure is required to form a treated layer comprising mainly TiC on the surface layer of the titanium metal under low-pressure, low-current-density, high-voltage conditions. At a low pressure below the lower limit, the carbon content in the treated layer would be low, so that the sliding properties would not be sufficiently improved. At a high pressure exceeding the upper limit, the carbon content in the carburized layer would reach a saturated value, so that the carburizing effect would not improve any further. In view of such a tendency, a more preferable carburizing gas pressure is 13-53 Pa (=0.1-0.4 torr).

The plasma carburization according to this invention can be carried out in the following manner using a known carburizing apparatus (made by NDK Incorporated).

First, an article formed of a titanium metal is put in a treating chamber. After exhausting, it is heated to a temperature of 400-690° C. by a heater, nitrogen gas containing hydrogen gas is introduced and the article is held at the temperature for 10-60 minutes. Simultaneously, cleaning treatment is carried out to remove an oxide film formed on the surface of the titanium metal by applying a high DC voltage of 200-1500 V.

Next, a carburizing gas comprising a hydrocarbon gas, hydrogen gas, etc. and having the atomic weight ratio (H/C) of hydrogen atoms (H) to carbon atoms (C) adjusted to $1 \leqq H/C \leqq 9$ is introduced into the furnace so that the pressure will be within the range of 13-400 Pa. A high DC voltage of 400-600 V is applied at a current density of 0.1 $A/m^2$-5 $A/m^2$ for plasma carburizing. In the plasma gas, ionized activated carbon C+will be produced, which adheres to the metal surface and further diffuses into the interior, or by the action of sputtering or implantation, carburizing reaction proceeds.

The atmospheric temperature for the plasma carburizing in this invention should be 400-690° C. If lower than 400° C., no matter how the current, voltage and carburizing gas pressure are adjusted, activated carbon could not penetrate into the titanium metal or diffuse therein. Also, if higher than 690° C. limit, the strength of the titanium metal might decrease.

According to the plasma carburizing method described above, it is possible to form a carburized layer as thick as e.g. 20 μm or over on the metal surface. Because no clear boundary is formed against the non-carburized portion of the metal, it is possible to form a less peelable and durable surface treated layer and thus to increase the lubricity and to reduce the friction coefficient by carbides and improve the wear resistance and corrosion resistance of the metal.

Also, with the treated layer on the titanium metal surface, it is considered that by being carbonized, its carbide exhibits lubricity. This reduces friction coefficient and wear amount. But, it will not lower the corrosion resistance of the titanium metal. Also, because the treated layer can be formed into a relatively thick layer of e.g. about 70 μm, it is possible to form a durable surface treated layer.

EXAMPLES 1-4 and COMPARATIVE EXAMPLES 1-3

For a titanium alloy (Ti-6Al-4V), a plurality of test pieces subjected to solution treatment (in which after held for one hour at 950° C., they were water-cooled) (in the Figure, they are abbreviated as ST), and test pieces subjected to solution treatment and aging treatment (in which after held for four hours at 540° C., they were air-cooled to room temperature) (in the Figure, they are abbreviated as STA) were prepared. After ultrasonic cleaning in acetone, they were subjected to plasma carburizing by use of the following device under the following conditions.

That is to say, a carburizing apparatus (made by NDK Incorporated) was used which had a treating chamber surrounded by a heat-insulating material such as graphite fiber in a heating furnace. While heating the interior of the treating chamber by use of heating elements made from a rod graphite, a DC glow discharge anode was connected to an upper portion of the treating chamber with a cathode connected to a table on which the articles to be treated were placed, and gas manifolds were provided at predetermined positions in the treating chamber so that process gases can be introduced by suitably changing over.

First, cleaning treatment was carried out at the cleaning temperatures and under other predetermined conditions shown in Table 1. The treating chamber was exhausted and heated by a heater to the predetermined cleaning temperatures shown in Table 1, argon gas and hydrogen gas were introduced at predetermined flow rates under predetermined gas pressures, and the specimens were held at predetermined current and voltage values for predetermined time to clean the titanium metal surface.

Next, plasma carburizing treatment was carried out at the carburizing temperatures and under other predetermined conditions shown in Table 2, and after treatment, nitrogen gas was pressed into the treating chamber and each specimen was cooled to room temperature.

Figure 2:
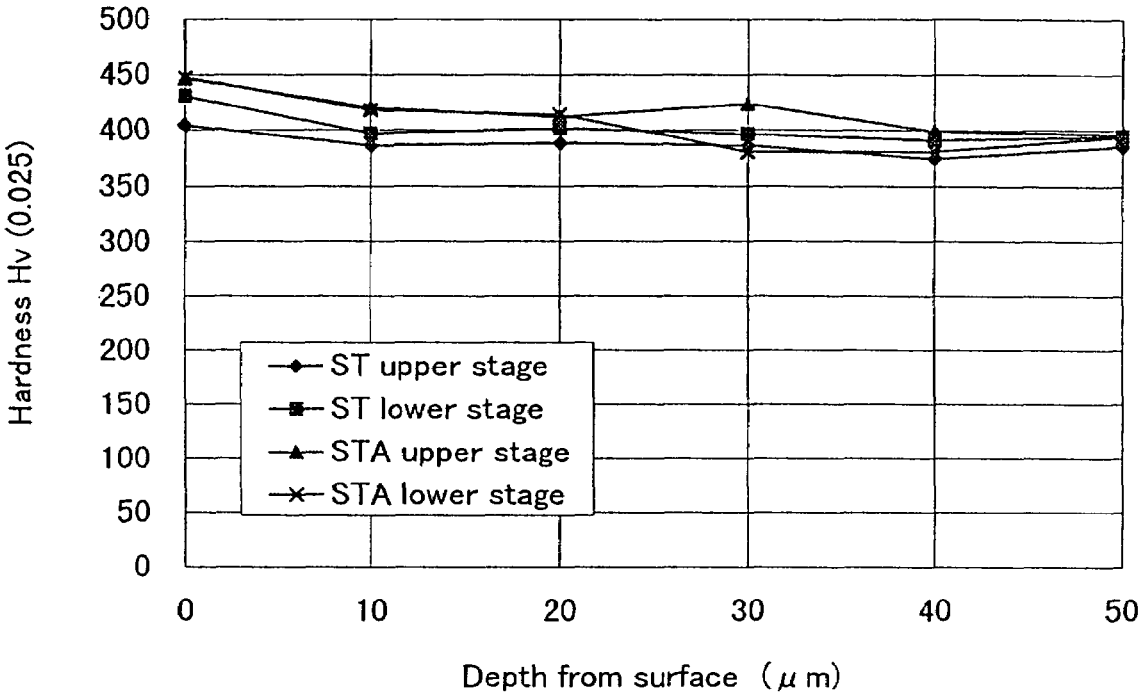
FIG. 2 is a graph showing the same relation in Example 2.
Figure 3:
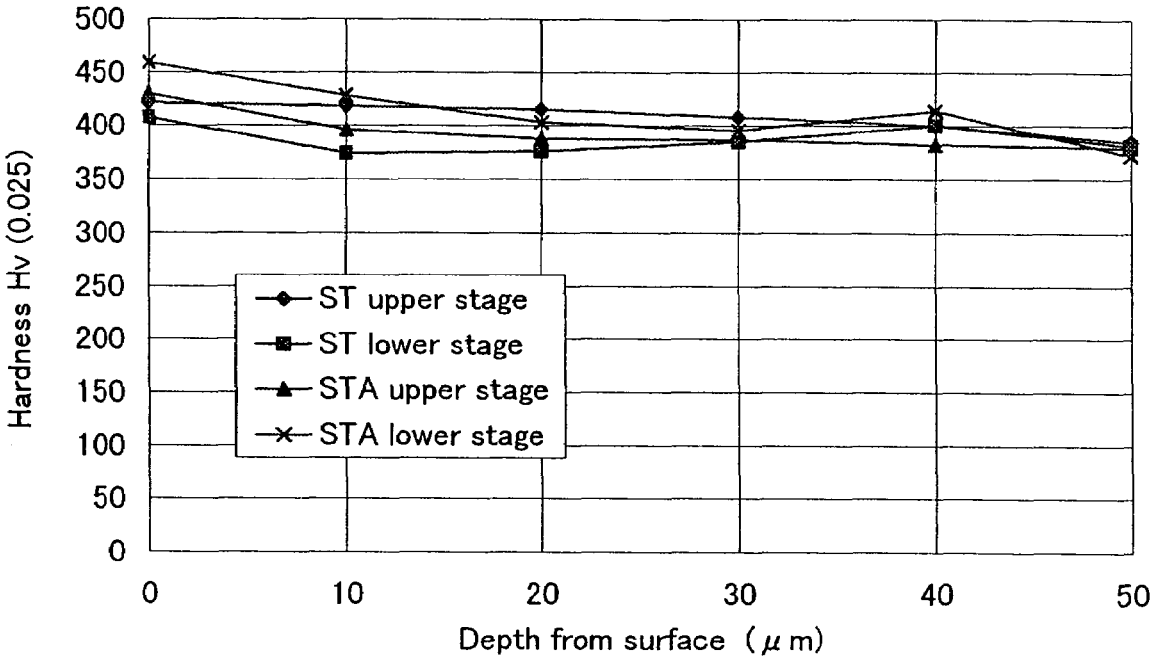
FIG. 3 is a graph showing the same relation in Example 3.
Figure 4:
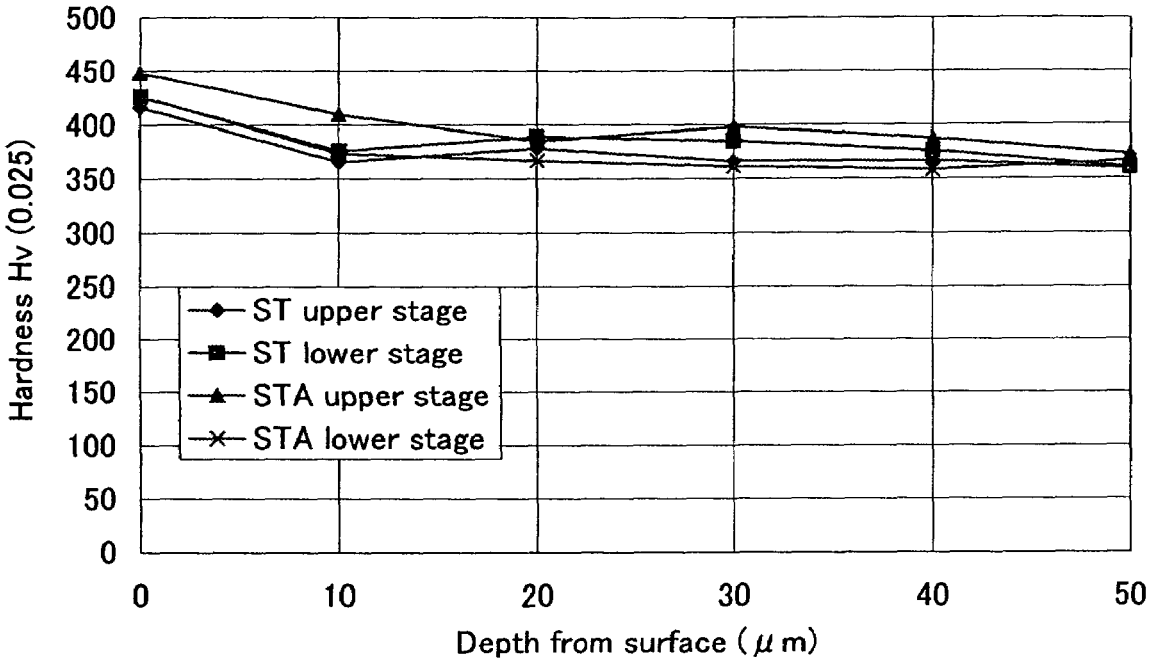
FIG. 4 is a graph showing the same relation in Example 4.
Figure 5:
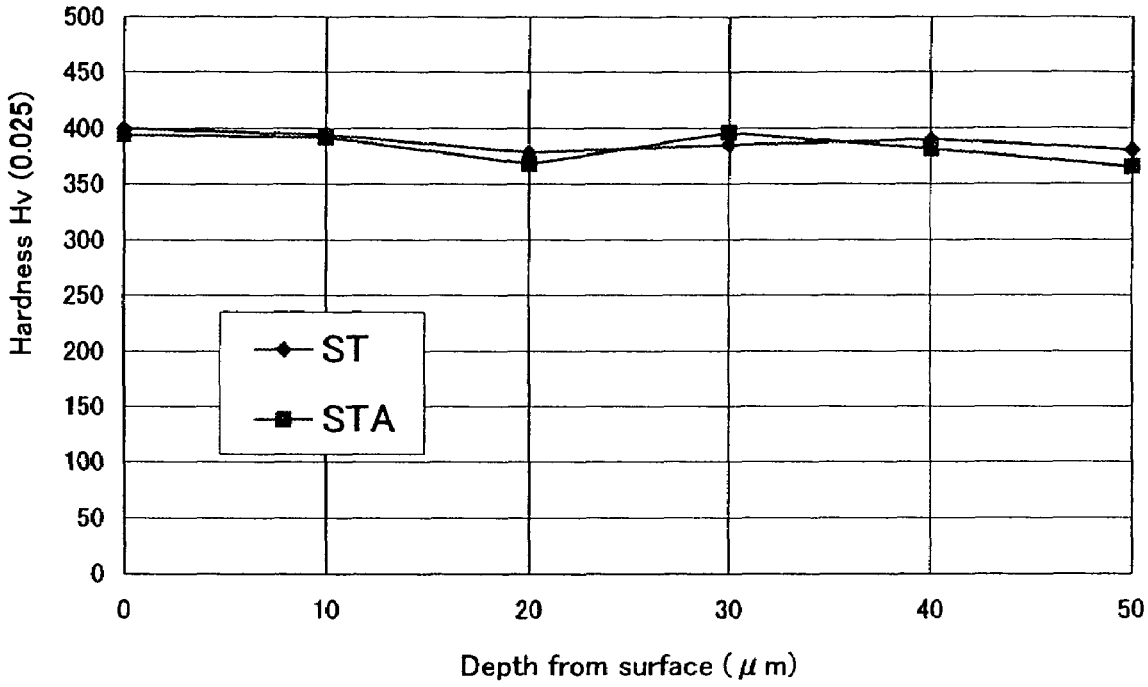
FIG. 5 is a graph showing the same relation in Comparative Example 1.
Figure 6:
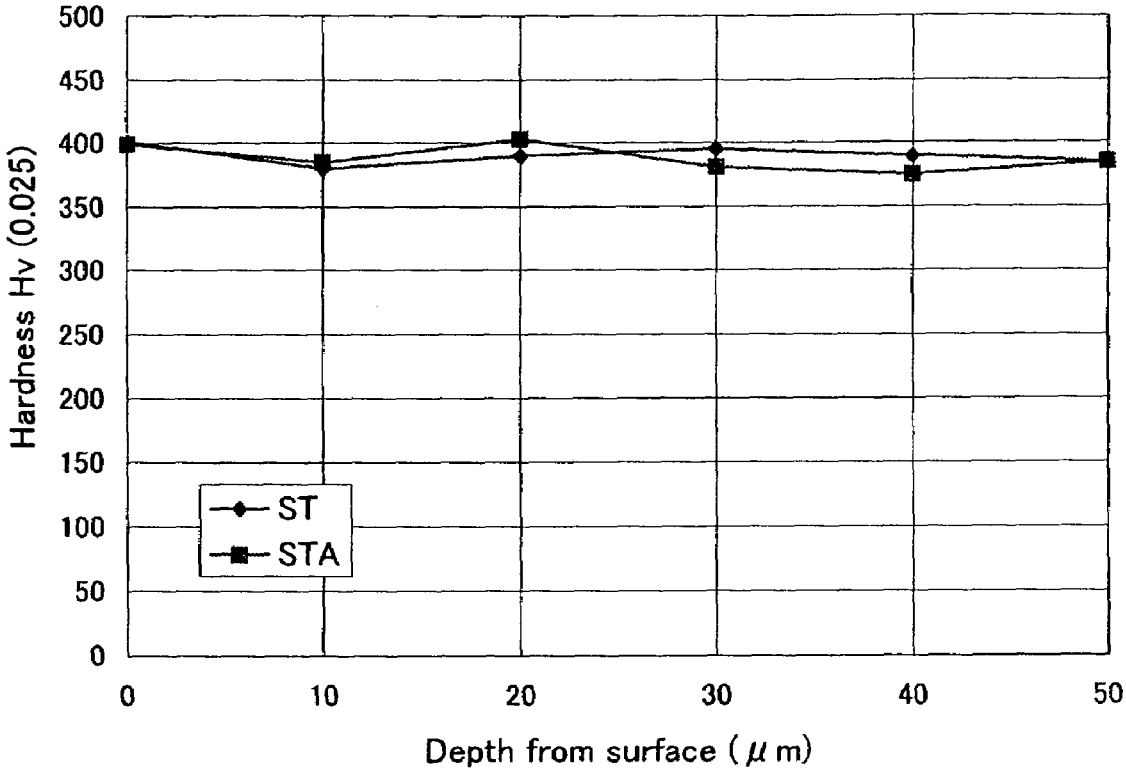
FIG. 6 is a graph showing the same relation in Comparative Example 2.
Figure 7:
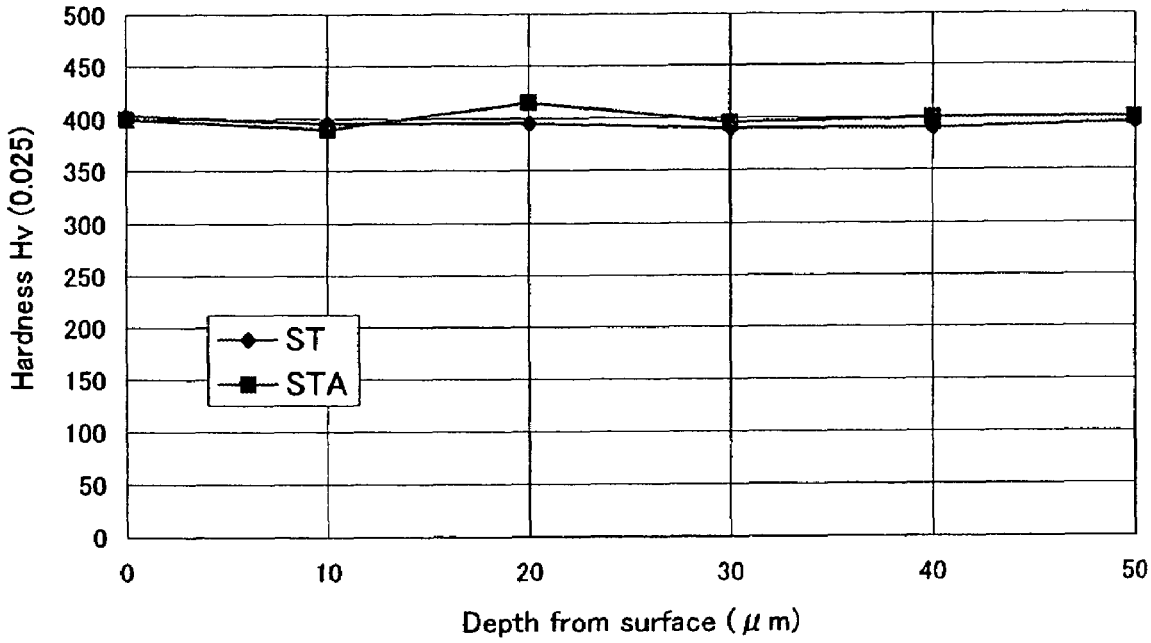
FIG. 7 is a graph showing the same relation in Comparative Example 3.
Figure 8:
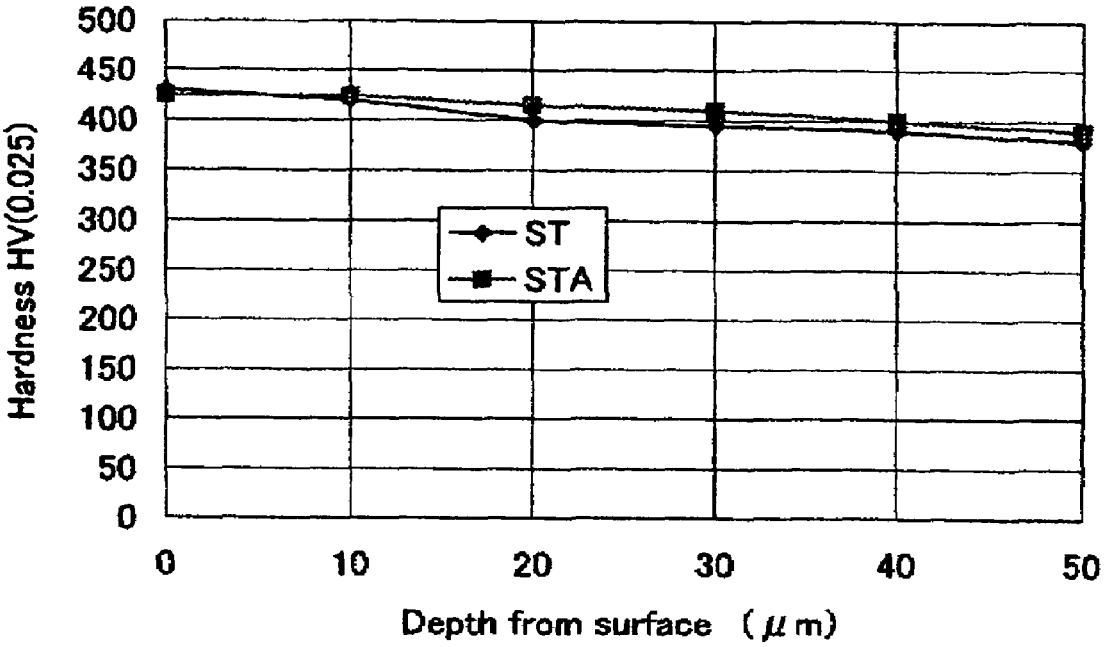
FIG. 8 is a graph showing the same relation in Example 5.
Figure 9:
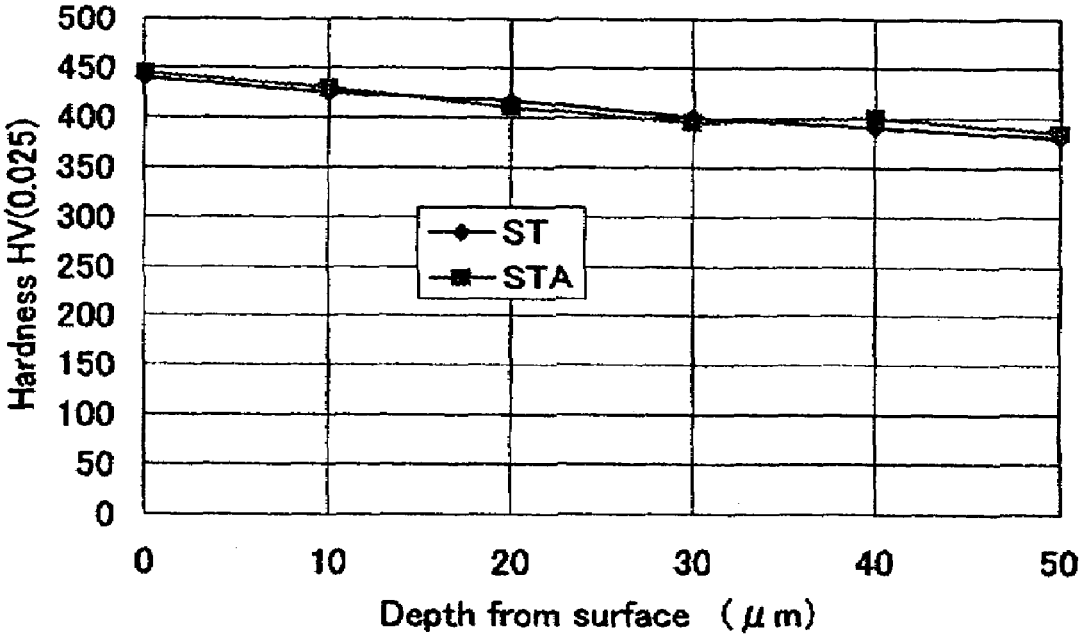
FIG. 9 is a graph showing the same relation in Example 6.
Figure 10:
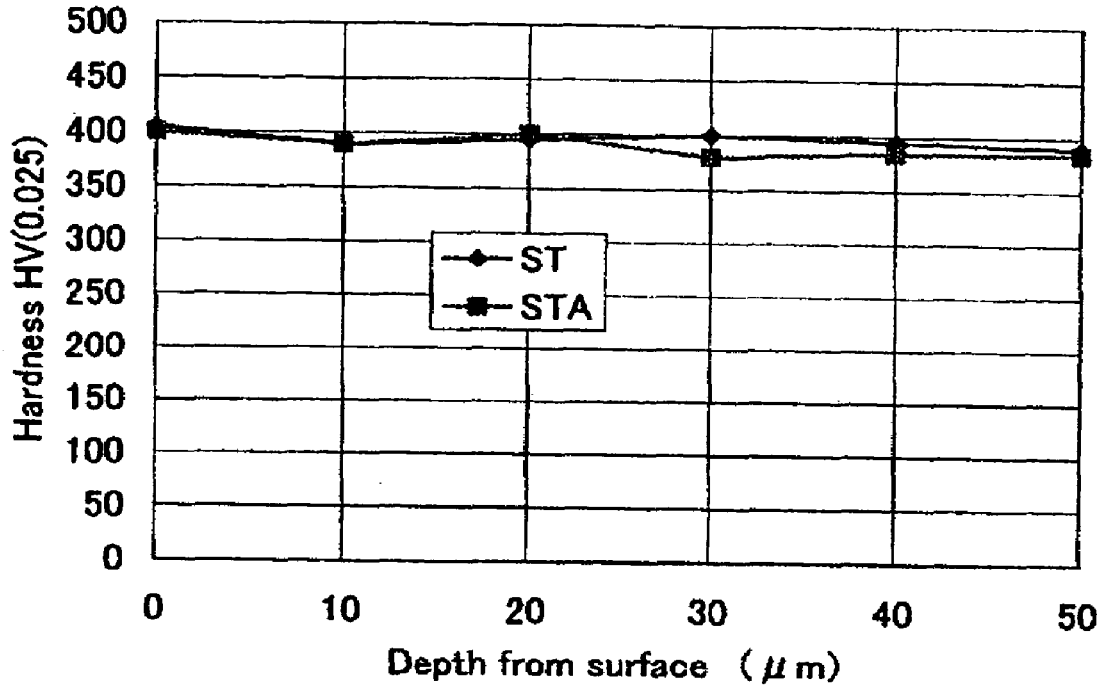
FIG. 10 is a graph showing the same relation in Comparative Example 4.
Figure 11:
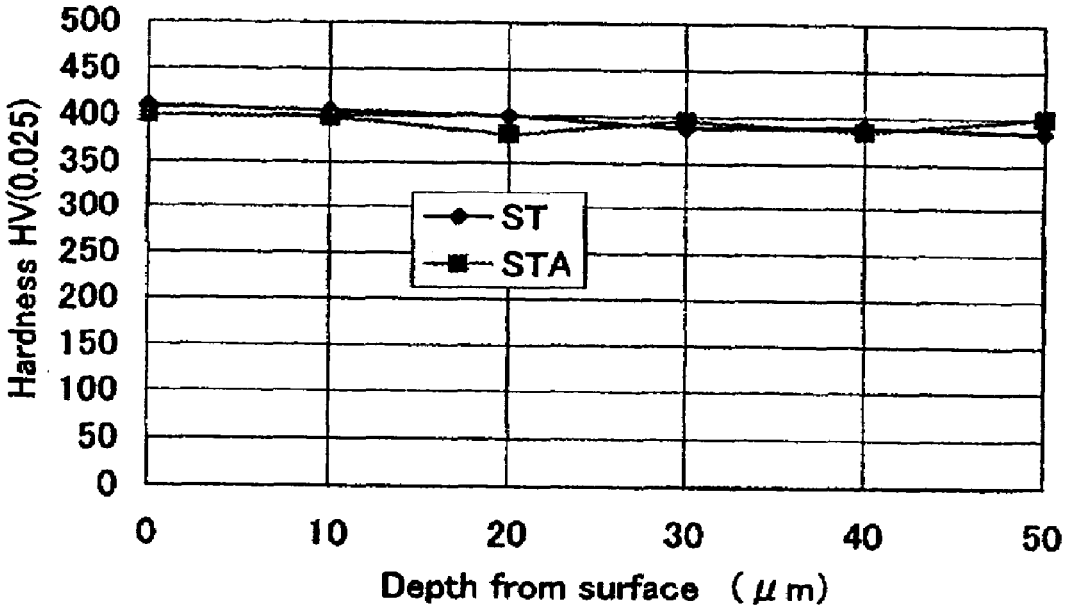
FIG. 11 is a graph showing the same relation in Comparative Example 5.

For plasma carburized products of Examples and Comparative Examples, which had been subjected to these treatments, the hardness (Hv) at a depth up to 50 μm from the surface at an arbitrary cut surface was measured using a micro Vickers hardness tester. The results are shown in FIGS. 1-11.

As is apparent from the conditions of Tables 1 to 4 and the results of FIGS. 1-11, ST and STA of Comparative Example 1 were specimens treated by a carburizing gas in which the (H/C) ratio exceeded 9 and both had a surface hardness (HV) of less than 400. In view of the fact that even if the depth from the surface increases, the hardness is uniform, it is considered that hardening due to carburization did not occur. In FIGS. 1-4, upper and lower stages for ST and STA refer to positions in the treating chamber. Comparative Examples 4 and 5 are cases in which ST and STA are such that the (H/C) value is less than one. Thus, hardening due to carburization scarcely occurred.

Also, ST and STA of Comparative Examples 2 and 3 were titanium metals treated by a carburizing gas in which the (H/C) ratio was 12, which exceeded 9, and both had a surface hardness (Hv) of less than 400. Thus, it is considered that hardening due to carburization did not occur.

In contrast, for Examples 1-4, which were treated by a carburizing gas of which the (H/C) ratio was 9 or below and 1 or over, the surface hardness (Hv) exceeded 400, and also even when the depth from the surface increased to about 20-50 μm, the hardness did not lower very much. This shows that the specimens were sufficiently carburized to such an extent that the hardness (Hv) exceeded at least 360.

According to this invention, it is possible to utilize low-current, high-voltage conditions. Thus, titanium metal can be subjected to plasma carburizing from the surface to a depth exceeding 50 μm at a low pressure of 26-400 Pa in a low-temperature atmosphere of 400-690° C. Also, as a result, the corrosion resistance of the titanium metal will not deteriorate, so that a relatively thick, durable sliding treated surface can be formed on its surface. Thus, it is possible to reduce the friction coefficient and wear amount in a stable state.

Also, because after subjecting the surface to cleaning treatment in a predetermined method, the titanium metal is subjected to plasma carburizing at predetermined pressure and temperature, it is possible to form a relatively thick, durable sliding treated surface on its surface without deteriorating the corrosion resistance of the titanium metal. Thus, the friction coefficient and wear amount can be reduced in a stable state.

TABLE 1

| | Example | | | | Comparative example | | |
|---|---|---|---|---|---|---|---|
| | 1 | 2 | 3 | 4 | 1 | 2 | 3 |
| Cleaning tem. ° C. | 585 | 480 | 480 | 585 | 500 | 480 | 470 |
| Cleaning time min | 15 | 15 | 15 | 15 | 20 | 20 | 20 |
| Gas pressure Pa | 46.7 | 53.3 | 53.3 | 53.3 | 50 | 52 | 53.3 |
| Current A | 0.4 | 0.4 | 0.4 | 0.4 | 4.5 | 4.8 | 3.6 |
| Voltage V | 455 | 445 | 440 | 465 | 580→650 | 550→625 | 620 |
| Gas flow rate cc/min | | | | | | | |
| Ar | 30 | 30 | 30 | 30 | 80 | 80 | 80 |
| H2 | 180 | 180 | 180 | 180 | 180 | 180 | 200 |

TABLE 2

| | Example | | | | Comparative example | | |
|---|---|---|---|---|---|---|---|
| | 1 | 2 | 3 | 4 | 1 | 2 | 3 |
| Carburizing temp. ° C. | 585 | 480 | 480 | 585 | 500 | 480 | 470 |
| Carburizing time min | 180 | 2000 | 180 | 180 | 8 | 8 | 8 |
| Gas pressure Pa | 26.7 | 26.7 | 26.7 | 29.3 | 160 | 180 | 200 |
| Current A | 0.5 | 0.5 | 0.5 | 0.5 | 4.9 | 4.8 | 4.6 |
| Voltage V | 565 | 490 | 505 | 500 | 580→500 | 580→560 | 600→480 |
| Gas flow rate cc/min | | | | | | | |
| C3H8 | 20 | 20 | 20 | 20 | 40→30 | 30 | 25 |
| H2 | 100 | 100 | 100 | 130 | 250→260 | 300 | 250 |

TABLE 2-continued

| | Example | | | | Comparative example | | |
|---|---|---|---|---|---|---|---|
| | 1 | 2 | 3 | 4 | 1 | 2 | 3 |
| H/C ratio | 6.3 | 6.3 | 6.3 | 8.16 | 9.12 | 12.46 | 12.46 |
| Cooling gas | N2 | N2 | N2 | N2 | N2 | N2 | N2 |

TABLE 3

| | Comparative example | | Example | |
|---|---|---|---|---|
| | 4 | 5 | 5 | 6 |
| Cleaning tem. ° C. | 585 | 585 | 585 | 585 |
| Cleaning time min | 30 | 30 | 30 | 30 |
| Gas pressure Pa | 60 | 60 | 60 | 60 |
| Current A | 0.5 | 0.5 | 0.5 | 0.5 |
| Voltage V | 450 | 450 | 450 | 450 |
| Gas flow rate | | | | |
| Ar | 30 | 30 | 30 | 30 |
| H2 | 180 | 180 | 180 | 180 |

TABLE 4

| | Comparative example | | Example | |
|---|---|---|---|---|
| | 4 | 5 | 5 | 6 |
| Carburizing temp. ° C. | 585 | 585 | 585 | 585 |
| Carburizing time min | 180 | 180 | 180 | 180 |
| Gas pressure Pa | 280 | 200 | 180 | 150 |
| Current A | 0.5 | 0.5 | 0.5 | 0.5 |
| Voltage V | 500 | 500 | 500 | 500 |
| Gas flow rate | | | | |
| C3H8 | 300 | 200 | 150 | 100 |
| H2 | 0 | 100 | 150 | 200 |

TABLE 4-continued

| | Comparative example | | Example | |
|---|---|---|---|---|
| | 4 | 5 | 5 | 6 |
| H/C ratio | 0.22 | 0.83 | 1.44 | 2.66 |
| Cooling gas | N2 | N2 | N2 | N2 |

What is claimed is:

1. A method of surface treatment of a titanium metal comprising plasma carburizing in an atmosphere comprising a carburizing gas having a composition thereof adjusted such that an (H/C) atomic weight ratio of hydrogen atoms (H) to carbon atoms (C) is $1 \leqq H/C \leqq 9$ at a pressure of 13-400 Pa and a temperature of 400-690° C.

2. A method of surface treatment of a titanium metal comprising heating the titanium metal to a temperature of 400-690° C. in a cleaning gas atmosphere containing hydrogen gas, subjecting the surface of the titanium metal to cleaning by applying a DC voltage of 200-1500 V, and plasma carburizing in an atmosphere comprising a carburizing gas having a composition thereof adjusted such that an (H/C) atomic weight ratio of hydrogen atoms (H) to carbon atoms (C) is $1 \leqq H/C \leqq 9$ at a pressure of 13-400 Pa and a temperature of 400-690° C.

* * * * *